United States Patent [19]

Schefer

[11] Patent Number: 4,662,385

[45] Date of Patent: May 5, 1987

[54] COSMETIC APPLICATOR

[75] Inventor: Eli I. Schefer, Sands Point, N.Y.

[73] Assignee: Revlon, Inc., New York, N.Y.

[21] Appl. No.: 369,437

[22] Filed: Apr. 19, 1982

Related U.S. Application Data

[63] Continuation of Ser. No. 117,387, Mar. 21, 1980, abandoned.

[51] Int. Cl.[4] ..... A45D 40/30

[52] U.S. Cl. ..... 132/88.5

[58] Field of Search ..... 132/88.7, 88.5, 143; 15/111, 104.5; 401/283

[56] References Cited

U.S. PATENT DOCUMENTS

| | | | |
|---|---|---|---|
| 1,302,247 | 4/1919 | Troy | 15/104.5 UX |
| 1,323,463 | 12/1919 | Friedt | 132/143 |
| 1,546,322 | 7/1925 | Solary | 15/104.5 |
| 3,908,676 | 9/1975 | Levine | 15/111 |

*Primary Examiner*—Gregory E. McNeill

[57] ABSTRACT

A combined brush and roll-on cosmetic applicator comprising a rod, a spiral brush disposed within a shroud; the assembly of which gives a brush-like applicator with a row or rows of bristles rising perpendicular to the axis of the rod for the application of a cosmetic product.

5 Claims, 6 Drawing Figures

FIG. 1
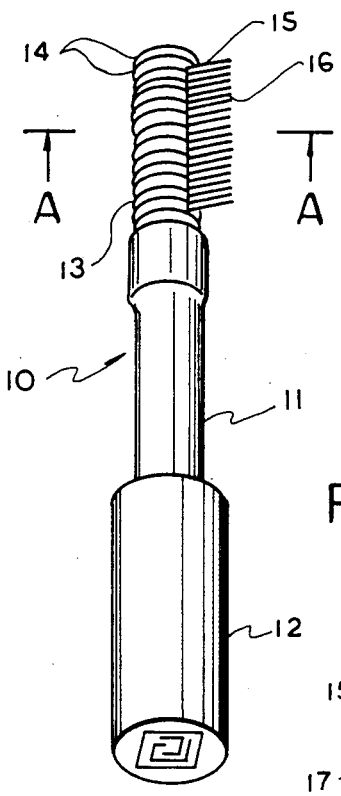
FIG. 2
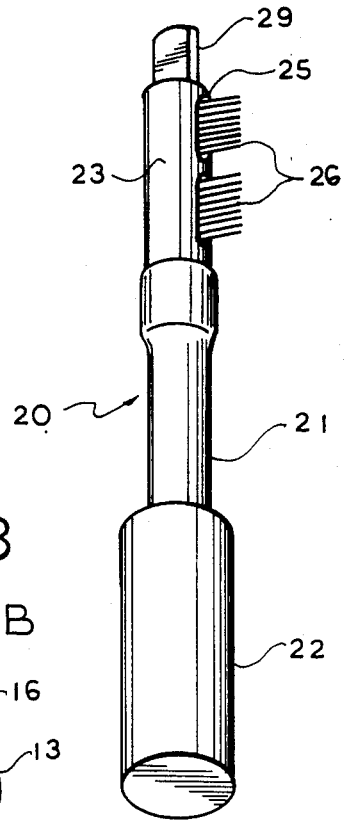
FIG. 3
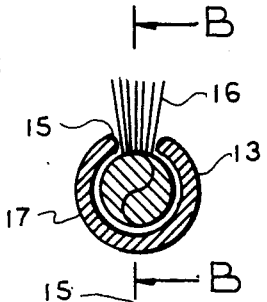
FIG. 4
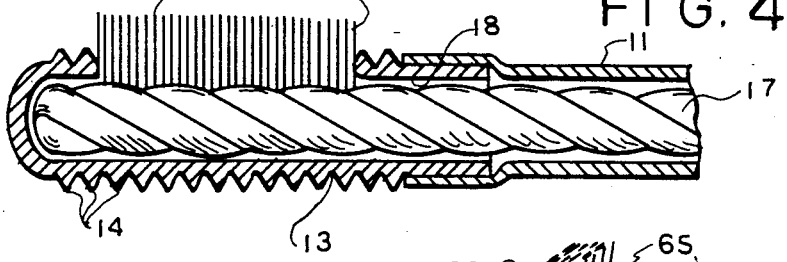
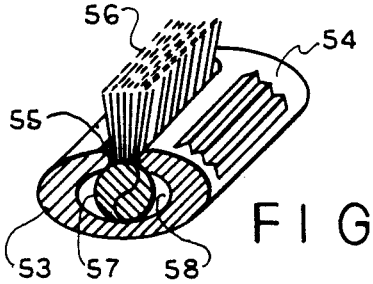
FIG. 5
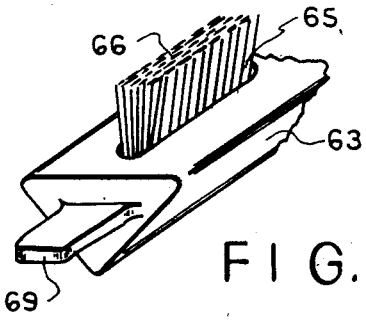
FIG. 6

COSMETIC APPLICATOR

This application is a continuation of Ser. No. 117,387, now abandoned.

BACKGROUND OF THE INVENTION (1) Field of the Invention

This invention relates to devices for applying cosmetics. More particularly, the devices of this invention relate to an improved applicator for applying cosmetics having both brush and roll-on structures as well as a spreading tip for cosmetic application or pusher tip for cuticle treatment.

(2) The Prior Art

The application of cosmetics is common in the make-up of the female face. To make-up eyelashes the proper amount of mascara is applied to the eyelashes with a comb. The mascara is then more evenly spread over the lashes, the lashes separated, if necessary, and thereafter fluffed and curled using a brush. It, thus, has been necessary to use separate devices. Prior art attempts have been made to combine the effects of combing and brushing into a single device. Combination mascara applicators are described in U.S. Pat. Nos. 3,908,676 and 3,921,650.

It is the general object of the present invention to provide a cosmetic applicator which will apply a desired amount of make-up.

Another object of the present invention is to provide a cosmetic applicator having both brush and roll on structures both of which can be simultaneously inserted into a cosmetic container.

A further object of the present invention is to provide a cosmetic applicator having both brush and roll-on features in combination with a spreading tip or cuticle pusher.

Still another object of the present invention is to provide a cosmetic applicator which can be easily wiped to remove excess cosmetics therefrom.

These and other objects, features and advantages of the present invention will become apparent from the following detailed description taken in conjunction with the drawings.

SUMMARY OF THE INVENTION

The objects of the present invention are achieved by an applicator which consists of a rod, a spiral brush and a shroud; the assembly of which gives a brush-like applicator with a row or rows of bristles rising perpendicular to and in line with the axis of the rod handle. The row or rows of bristles can be continuous or intermittent. The shroud is a tubular piece whose external shape may be round, elliptical, triangular, rectangular or any other desirable shape. The shroud being tubular may have a circular hole concentric with the outside diameter or shape, or the hole may be in the external shape of the shroud. The shroud has a slit or series of slits to allow specific bristles of the spiral brush to protrude and not be constrained within the internal hole. The applicator is assembled by inserting the spiral brush into the shroud and attaching this assembly to the rod by gluing, press fitting, staking or the like.

The shroud may have grooves, splines, threads or the like on the external surface. These external configurations may extend around the shroud, longitudinal along the length of the shroud or hexially around the shroud, as desired to suit the purpose of the application.

An additional feature of the applicator is that at the end of the shroud there may be formed a narrow tip which is so shaped to serve as a spreading tip for cosmetics or a pusher tip for cuticles.

BRIEF DESCRIPTION OF THE DRAWINGS

FIG. 1 is a perspective view of an embodiment of the cosmetic applicator according to the invention.

FIG. 2 is a perspective view of another embodiment of the cosmetic applicator according to the invention in which the end of the applicator forms a narrowed tip for spreading cosmetics.

FIG. 3 is a transverse cross-section view taken along line A—A of FIG. 1.

FIG. 4 is a partial longitudinal cross-section view taken along line B—B of FIG. 3.

FIG. 5 is a partial perspective, transverse cross-sectional view similar to FIG. 3 showing an embodiment of the cosmetic applicator according to the invention having an eliptical shroud.

FIG. 6 is a partial perspective view showing an embodiment of the cosmetic applicator according to the invention having a triangular shroud and a spreading tip on the end.

DETAILED DESCRIPTION OF THE INVENTION

Referring now to the drawings and in particular to FIG. 1, there is shown the cosmetic applicator of this invention, generally designated as 10. The applicator includes rod 11 having a handle 12 attached to the rod. The rod may be cylindrical and constructed of plastic or other rigid material. A tubular shroud 13, shown in FIG. 1 having a substantially circular external configuration, is provided having a slit 15 extending part way down the shroud in the direction of the axis of the rod. The shroud may be of metal, plastic or other suitable material. Extending through slit 15 are the unrestricted brush bristles of spiral brush 16.

An optional feature of the mascara applicator, as clearly shown in the preferred embodiment of FIG. 1, is a series of evenly spaced horizontal grooves 14 extending circumferentially around shroud 13 in a direction perpendicular to the axis of the rod. The grooves 14 serve to provide a comb-like effect for easily applying mascara to eyelashes. While the embodiment shown in FIG. 1 is a preferred embodiment it should be understood that the grooves may also be in the form of splines or threads and further the grooves may extend longitudinally along the shroud axis as shown by grooves 54 in FIG. 5 or hexially around the shroud, not shown.

As shown in FIGS. 3 and 4, a brush comprising a row or rows of bristles 16 is attached to rigid wire 17. While the brushes illustrated in FIGS. 3, 4 and 5 show only a row of bristle for clarity, it should be understood that the spiral wire brushes shown have bristles all the way around the wire. The spiral brush is inserted into internal hole 18 of shroud 13 with the bristles 16 extending through slit 15. The rigid wire is of such size that when the brush is properly inserted into the shroud it is held comfortably in place. It should be understood that where desirable a plurality of slits in the shroud with rows of bristles extending three-through may be used. When assembled, shroud 13 having the brush placed therein, is attached as shown in FIG. 3 to rod 11 by any suitable means such as gluing, press fitting, or staking.

In FIG. 2 there is shown an alternative embodiment of the cosmetic applicator of this invention, generally designated as 20. The applicator includes rod 21 having attached thereto handle 22. A tubular shroud 23 is provided having a plurality of slits 25 extending part way down the shroud in the direction of the rod. A brush of the type described in FIG. 2 having an intermittent row of bristles is inserted into the shroud 23 and as shown bristles 26 extend through slits 25. At the end of the shroud there is provided spreading tip 29.

The shroud may be of any desirable configuration, such as the circular configurations of FIGS. 1 and 2. Another embodiment of the applicator is for the shroud to be eliptically shaped as shown by shroud 53 in FIG. 5. Elliptically shaped shroud 53 may have any convenient shape for internal hole 58, which as shown is also elliptical. A brush having bristles 56 attached to rigid wire 57 is inserted into internal hole 58 with the bristles extending through slit 55.

In FIG. 6 there is shown a partial perspective view of yet another embodiment of the cosmetic applicator of this invention wherein shroud 63 has a triangular configuration. In FIG. 6 shroud 63 has at its end a spreading tip 69. The other end of shroud 63, having brush bristles 66 extending through slit 65, is attached to a rod, not shown.

The cosmetic applicator is typically sold in combination with a container of liquid cosmetic product, such as mascara, wherein the applicator is immersed into the liquid product with the handle serving as the top for the container. When the applicator is removed from the liquid container excess product is easily wiped from the applicator.

The invention and its attendant advantage will be understood from the foregoing description and it will be apparent that various changes may be made in the form, construction, materials and arrangement of the parts of the invention without departing from the spirit and scope thereof, the arrangement hereinbefore described being merely by way of example.

What is claimed is:

1. An eyelash cosmetic applicator comprising:

a rod;

a handle attached to one end of said rod;

said rod having a reduced diameter portion at its other end for receiving a tubular shroud thereon;

said shroud receiving portion of said rod formed with a longitudinal opening;

a tubular shroud having at least one slit thereon extending longitudinally, one end of said shroud having an opening communicating with said slit for receiving said rod thereon;

a brush comprising bristles attached to a wire and slideably disposed within said shroud and opening, said wire portion of said brush being removably disposed within said longitudinal opening of said rod, said bristles extending through said shroud slit whereby said rod, shroud, and brush are removable from one another.

2. The cosmetic applicator according to claim 1 wherein the exterior shape of said shroud is circular.

3. The cosmetic applicator according to claim 1 wherein the exterior shape of said shroud is triangular.

4. The cosmetic applicator according to claim 1 wherein the exterior shape of said shroud is elliptical.

5. The cosmetic applicator according to claim 1 wherein there is a series of spaced grooves around the exterior of said shroud.

* * * * *